US005542141A

United States Patent [19]

Albright

[11] Patent Number: 5,542,141

[45] Date of Patent: Aug. 6, 1996

[54] WATER POWERED APPARATUS FOR CLEANING AQUATIC BODIES

[76] Inventor: Alva Z. Albright, 1927 Albert St., Alexandria, La. 71301

[21] Appl. No.: 419,137

[22] Filed: Apr. 10, 1995

[51] Int. Cl.[6] ..... E04H 4/16

[52] U.S. Cl. ..... 15/1.7

[58] Field of Search ..... 15/1.7; 210/169

[56] References Cited

U.S. PATENT DOCUMENTS

| | | | |
|---|---|---|---|
| 3,972,339 | 8/1976 | Henkin et al. | 15/1.7 |
| 4,589,986 | 5/1986 | Greskovics et al. | 15/1.7 |
| 5,172,445 | 12/1992 | Chandler | 15/1.7 |
| 5,245,723 | 9/1993 | Sommer | 15/1.7 |
| 5,412,826 | 5/1995 | Raubenheimer | 15/1.7 |

FOREIGN PATENT DOCUMENTS

| | | | |
|---|---|---|---|
| 2685374 | 6/1993 | France | 15/1.7 |

*Primary Examiner*—David Scherbel
*Assistant Examiner*—Tony G. Soohoo
*Attorney, Agent, or Firm*—David L. Ray

[57] ABSTRACT

In accordance with the present invention there is provided a water driven cleaning apparatus for aquatic bodies such as swimming pools which travels in any desired direction on the bottom of a swimming pool and has controls connected thereto which are operable by a person located adjacent to the pool. The water powered apparatus for cleaning aquatic bodies includes a rigid frame, a bin connected to the rigid frame for collecting and holding debris removed from the aquatic body, wheels connected to the rigid frame for supporting and moving the apparatus along the bottom of the aquatic body, a motor for driving the drive wheels, the motor being driven by water under pressure, and a suction tube connected to the rigid frame for inducting water from the aquatic body into the bin to remove debris from the water.

29 Claims, 6 Drawing Sheets

WATER POWERED APPARATUS FOR CLEANING AQUATIC BODIES

BACKGROUND OF THE INVENTION

1. Field of the Invention

The invention relates to cleaning apparatus for aquatic bodies. More particularly, the present invention relates to apparatus for cleaning water containment facilities such as swimming pools and the like.

2. Description of the Related Art

Pool cleaning devices are known in the art. Exemplary of the pool cleaning apparatus of the prior art are those which travel about the pool on a random travel basis and trap particles therein. These devices have the disadvantage of becoming trapped in the corners of the pool and against ladders and other objects found in the pool, although some of these devices incorporate mechanisms for backing up and escaping such entrapment. Furthermore, it is not uncommon for dirt and debris to be left in areas of the pool as large as three square feet even after two or more hours of operation.

Entrapment of pool cleaning devices is also avoided by utilizing guidance systems. The cleaning devices may be programmed or guided by tracks, wires, cables or the like. The devices may also turn or reverse when an obstacle is encountered.

Other devices of the prior art strain water through a sack or bag which retains the debris while allowing the water to escape. The sack or bag must be removed periodically for emptying and cleaning. Such removal and cleaning is laborious and tedious. The sack or bag must be removed from the cleaning apparatus, and the sack or bag commonly has a tie or other method of closure around the vacuum of the cleaning apparatus which sometimes entails the removal of a panel to gain access to the sack or bag.

If one attempts to invert the sack and pour the debris therefrom through the restricted opening to the sack, the debris may lodge in the opening of the sack and further restrict the opening to the sack. If the sack has a more unrestricted opening elsewhere therein such as an opening closed by Velcro® or the like, the sack may need to be turned inside out and washed. Replacement of the sack must be performed carefully since improper placement of the sack will not permit the cleaning apparatus to function properly.

SUMMARY OF THE INVENTION

In accordance with the present invention there is provided a water driven cleaning apparatus for aquatic bodies such as swimming pools which travels in any desired direction on the bottom of a swimming pool and has controls connected thereto which are operable by a person located adjacent to the pool.

The invention has the advantage of employing a single source of pressurized water to clean, drive, steer, rotate, and control a pool cleaning apparatus.

The present invention has the further advantage being easily driven in intricate maneuvers by the touch of the fingers of an operator standing in a dry area remote from the area being cleaned—no source of power other than pressurized water is needed.

The present invention has the additional advantage of utilizing the water in the pool as the source of water to be pressurized.

The present invention utilizes a bin for holding debris which may be quickly and easily removed and emptied.

DESCRIPTION OF THE PREFERRED EMBODIMENTS

Figure 1:
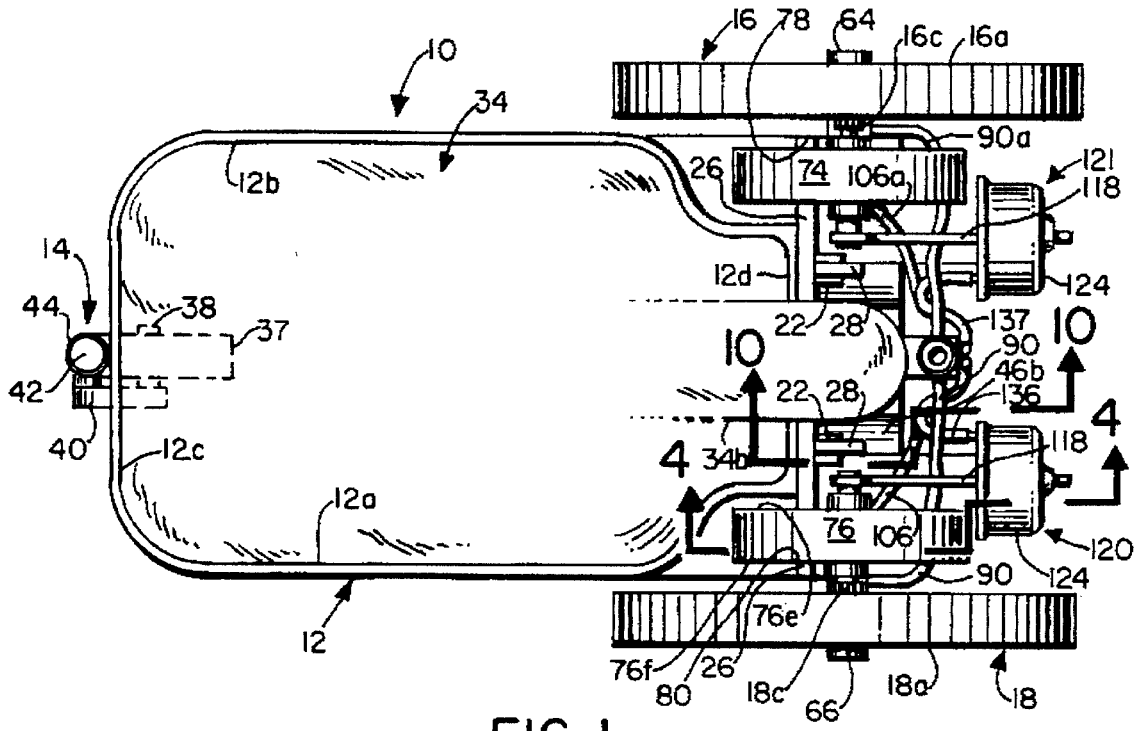
FIG. 1 is a top plan view of the cleaning apparatus of the invention.

In FIGS. 1, 2, 3, and 10 is shown the cleaning apparatus of the invention generally indicated by the numeral 10. Cleaning apparatus 10 includes a bin generally indicated by the numeral 12 which is supported by the caster wheel assembly generally indicated by the numeral 14, and two drive wheels generally indicated by the numerals 16 and 18, respectively. Debris is collected in bin 12. Drive wheels 16 and 18 propel cleaning apparatus 10 in the direction indicated by the arrow 20 in FIG. 11 when both drive wheels 16 and 18 are turning in the same direction at the same number of revolutions per unit of time.

Figure 3:
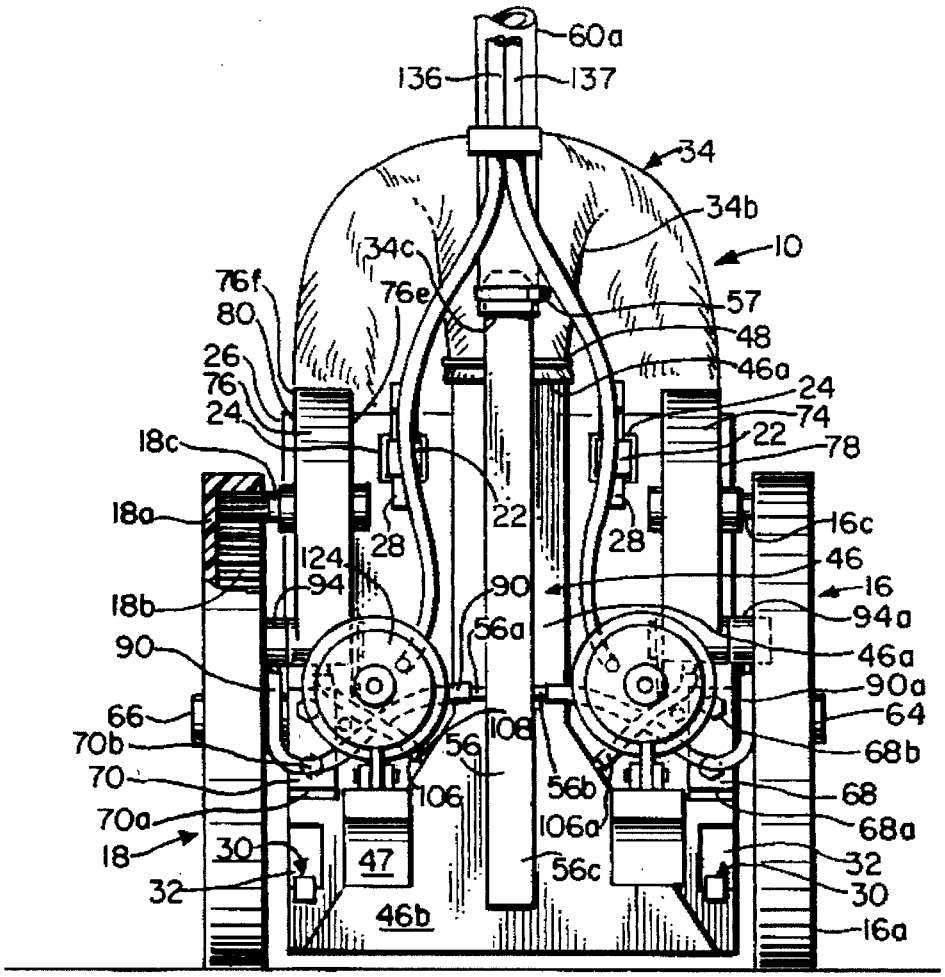
FIG. 3 is front elevational view of the cleaning apparatus of the invention.
Figure 10:
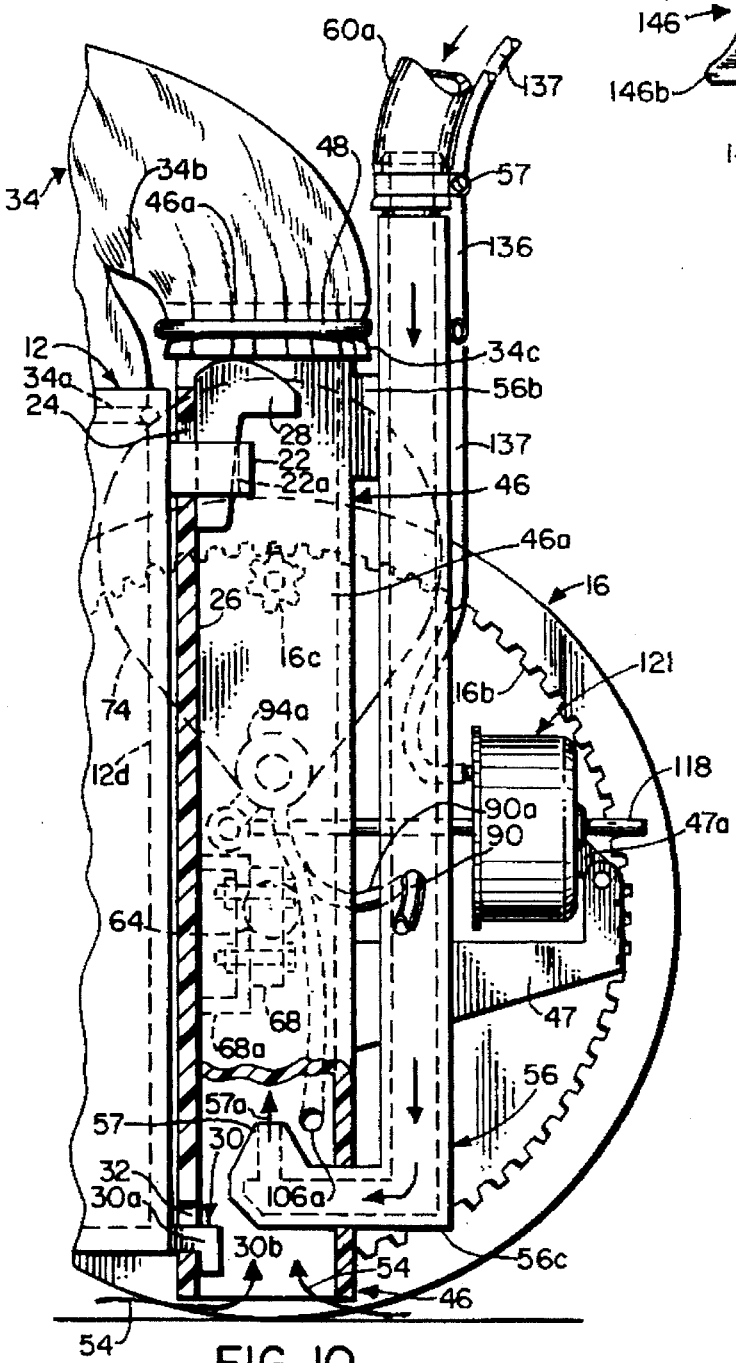
FIG. 10 is a partly cut-away, partly sectional view taken along lines 10—10 of FIG. 1.
Figure 10A:
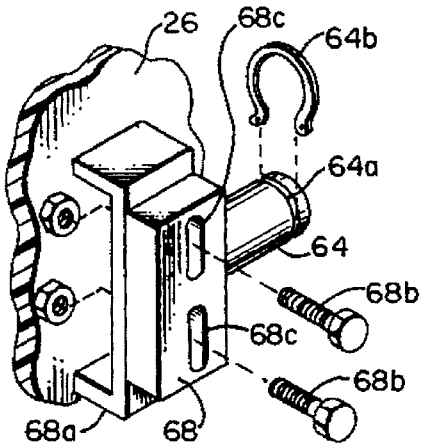
FIG. 10A is a partly cut-away, detailed view of an axle and axle holder.

Bin 12 preferably has two generally parallel rigid side walls 12*a* and 12*b* integrally molded with rear wall 12*c* and front wall 12*d*. Front wall 12*d* is preferably generally parallel to rear wall 12*c*. Front wall 12*d* preferably has two retainers 22—22 extending outwardly therefrom as shown in FIGS. 1, 3, and 10 which are slidably received in holes 24—24 of drive wheel frame 26. Retainers 22—22 each have a hole 22*a* therein as shown in FIG. 10 for receipt of wedges 28—28 as shown in FIGS. 1, 3, and 10 to selectively remove and fasten bin 12 to drive wheel frame 26 to enable bin 12 to be emptied when sufficiently full of debris removed from pool 52. Wedges 28—28 are the preferred fasteners because wedges 28—28 have the inherent ability to compensate for any wear by simply dropping into hole 22*a*—22*a* of retainers 22—22. However, if desired, other fasteners known in the art could be utilized.

Front wall 12*d* also has two lugs 30 located at the bottom thereof as shown in FIGS. 3 and 10 for slidable receipt in holes 32 in the lower portion of drive wheel frame 26. Lugs 30 have a horizontal portion 30*a* which extends through holes 32 and a vertical portion 30*b* which fits snugly against the front side of drive wheel frame 26.

Walls 12*a*, 12*b*, 12*c* and 12*d* form a top opening at the top edge thereof and a bottom opening at the bottom edge thereof. The top opening of bin 12 is covered by membrane 34 and the bottom opening of bin 12 is covered by membrane 36. As can be best seen in FIG. 2, membrane 34 has a cylindrical channel 34*b* therein which has an internal coil 38 of wire therein for holding channel 34*b* in the shape of a cylinder. The circular end 34*c* of channel 34*b* is connected to the upper end 46*a* of the suction tube generally indicated by the numeral 46 by clamp 48. Clamp 48 can be any conventional clamp known in the art such as a metal band connected at each end by a bolt and nut.

Figure 12:
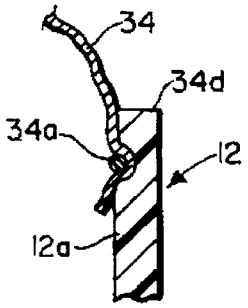
FIG. 12 a partly cut-away cross-sectional view taken along lines 12—12 of FIG. 1.

Membranes 34 and 36 are preferably cloth membranes and are held in place by wire spring or retainer 34*a* as shown in FIG. 12 and wire spring or retainer 36*a* as shown in FIG. 1. Retainer 34*a* is preformed to have the shape of the top of bin 12 and to be slightly larger in dimension so that it force fits in groove 34*d* on the inside of bin 12. Retainer 36*a* is preformed to have the shape of the bottom of bin 12 and to be slightly larger in dimension so that it force fits in groove 36*b* on the inside of bin 12. Membrane 34 can be removed from bin 12 by grasping and lifting away retainer 34*a*. Membrane 36 can also be removed from the bottom of bin 12 by grasping and lifting away retainer 36*a*.

Thus, bin 12 can be quickly and easily removed from drive wheel frame 26 by removing wedges 28—28 from retainers 22—22, removing membrane 34 from the top of bin 12, and lifting bin 12 away from drive wheel frame 26. Bin 12 can be replaced by re-engaging lugs 30—30 in holes 32—32, replacing wedges 28—28, and placing membrane 34 thereon.

Caster wheel assembly 14 has a wheel 37 which is rotatably connected to axle 38. Axle 38 is rigidly connected to arm 40, and arm 40 is rigidly connected to pin 42. Pin 42 is rotatably receiving in sleeve 44 which is rigidly connected to bin 12. Thus, caster wheel assembly 14 functions as a conventional caster wheel does. Pin 42 turns in sleeve 44 to enable wheel 37 to roll in any direction drive wheels 16 and 18 propel bin 12.

As can be seen in FIGS. 3 and 10, suction tube 46 is rigidly connected to drive wheel frame 26. Suction tube 46 has a hollow cylindrical-upper end 46*a* and a hollow, generally triangular shaped lower end 46*b*. Lower end 46*b* of suction tube 46 has a generally rectangular opening through which debris-containing water 50 in pool 52 on the outside of cleaning apparatus 10 is drawn upward as indicated by the arrows. 54 in FIG. 10 into suction tube 46 and discharged through the upper end 46*a* of suction tube 46 into the circular end 34*c* of channel 34*b* of membrane 34.

As can be seen in FIG. 10, water is inducted into suction tube 46 by water under superatmospheric pressure flowing through water inlet tube 56 and out of water inlet tube nozzle 57 in the direction indicated by arrow 57*a*. Water inlet tube 56 is hollow inside and is rigidly connected at its upper end to suction tube 46 by bracket 56*b*. The lower end of water inlet tube 56 has a horizontal portion 56*c* which is connected to the lower end of suction tube 46 and extends therethrough. Bracket 56*b* and horizontal portion 56*c* are connected to suction tube 46 and to water inlet tube 56 by any conventional method such as welding, gluing, screwing, or the like. Water 50 from pool 52 is supplied to water inlet tube 56 under superatmospheric pressure by pump 58 through hoses 60 and 60*a* connected to water inlet tube 56 by conventional clamp 57. Pump 58 could be replaced by a source of water such as the fresh water supply available to homes and business in the area of the pool to be cleaned if the fresh water supply has sufficient pressure to operate the cleaning apparatus of the invention.

Pump 58 receives water 50 from pool 52 through inlet hose or pipe 62. Pump 58 is driven by motor 58*a* which may be an electric motor or an internal combustion engine.

As can be seen in FIGS. 1, 3, 10, and 10*a*, drive wheels 16 and 18 are rotatably connected to axles 64 and 66, respectively. Axles 64 and 66 are rigidly connected to axle brackets 68 and 70, respectively, each of which is connected to axle bracket holders 68*a* and 70*a* by bolts 68*b*—68*b* and 70*b*—70*b*. Axle 64 preferably has a circular groove 64*a* therein for receipt of snap ring 64*b* to hold wheel 16 thereon. Axle 66 has a similar groove (not shown) and snap ring (not shown) therein for holding wheel 18 thereon.

Axle bracket holders 68 and 70 have elongated slots 68*c* and 70*c* therein to provide a limited range of adjustment of the height of axles 64 and 66. Axle bracket holders 68 and 70 are connected to drive wheel frame 26 as shown in FIGS. 3 and 10 by welding, gluing, or the like. Axles 64 and 66 are identical, as are axle brackets 68 and 70, bolts 68*b* and 70*b*, axle bracket holders 68*a* and 70*a*, and slots 68*c* and 70*c*.

Figure 2:
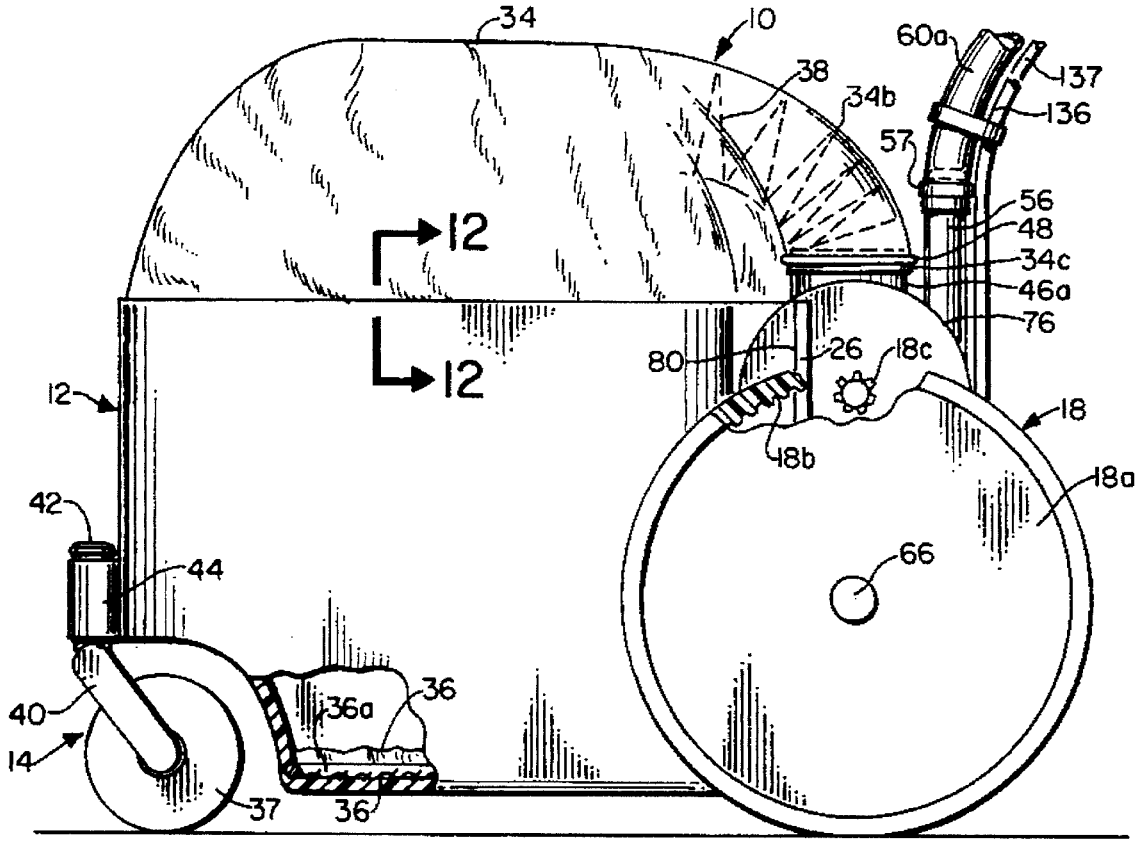
FIG. 2 is a side elevational view of the cleaning apparatus of the invention.

Drive wheels 16 and 18 each have a solid, circular outer wall 16*a* and 18*a*, respectively, and internal gears 16*b* shown in FIG. 10 and 18*b* shown in FIGS. 2 and 3 on the inside thereof, respectively. Two pinions 16*c* shown in FIGS. 1, 3, and 10 and 18*c* shown in FIGS. 1, 2, and 4 rotatably engage internal gears 16*b* and 18*b*, respectively, to drive each wheel 16 and 18, respectively.

Pinions 16*c* and 18*c* extend from turbine housings 74 and 76, respectively. Pinion 18*c* can be seen in FIG. 4 to be rigidly connected to and extend from turbine rotor 76*a* having vanes 76*b*. Turbine rotor 76*a* is rotatably mounted in turbine housing 76. Pinion 16*c* extends from a turbine rotor (not shown) identical to turbine rotor 76*a* having vanes 76*b* and is rotatably mounted in turbine housing 74. Turbine housings 74 and 76 are identical externally and internally, and are fitted in rectangular slots 78 and 80 shown in FIGS. 1 and 3 in drive wheel frame 26 and are rigidly connected thereto by welding, gluing, or the like.

Figure 4:
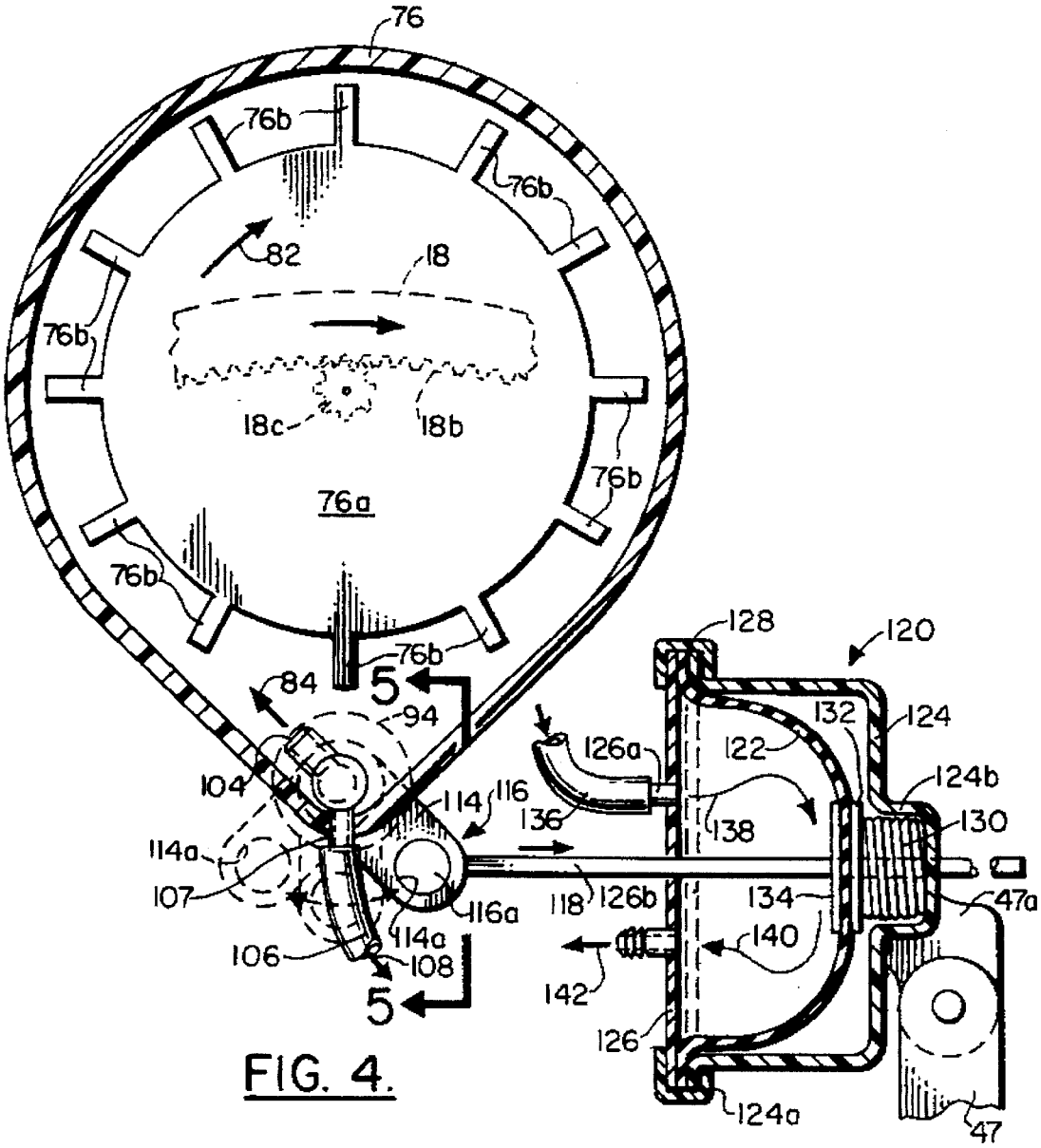
FIG. 4 is a partly cross-sectional view taken along lines 4—4 of FIG. 1.
Figure 6:
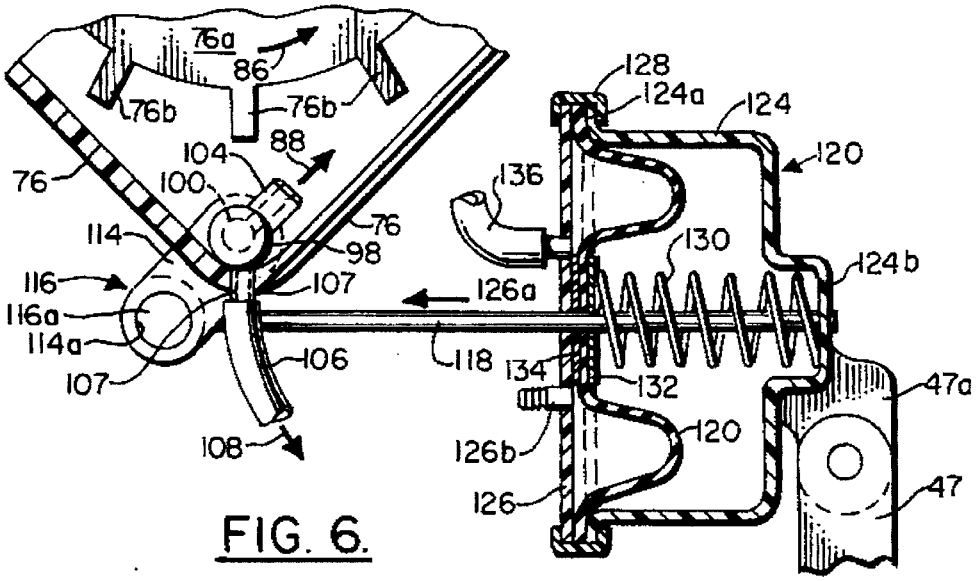
FIG. 6 is a partly cross-sectional, partly cut-away view of the lower portion of FIG. 4.

As can be seen in FIG. 4, turbine rotor 76*a* is forced to turn in the direction indicated by the arrow 82 in FIG. 4 by a stream of water flowing from nozzle 104 in the direction indicated by the arrow 84. As can be seen in FIG. 6, turbine rotor 76*a* is forced to turn in the direction indicated by the arrow 86 by a stream of water flowing from nozzle 104 in the direction indicated by the arrow 88.

Figure 5:
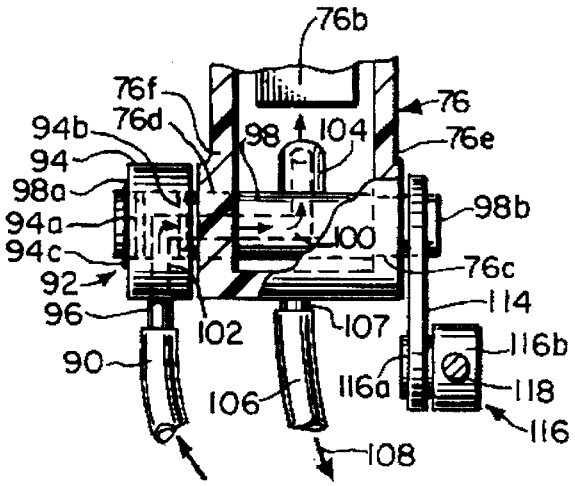
FIG. 5 is a cross-sectional view, partially cut-away, taken along lines 5—5 of FIG. 4.

As shown in FIGS. 1–3, 5, 10 and 11, water under superatmospheric pressure is conveyed from water hoses 60 and 60*a* to inlet tube 56. Water under superatmospheric pressure is conveyed from inlet tube 56 through rigid tube 56*a* which is rigidly connected thereto to flexible tube 90. Flexible tube 90 conveys water under superatmospheric pressure into the rotatable nozzle assembly generally indicated by the numeral 92 as shown in FIGS. 4–6.

As best shown in FIG. 5, rotatable nozzle assembly 92 has a generally cylindrical cap 94 having a rigid tube 96 rigidly connected thereto. Flexible tube 90 is force fitted onto rigid tube 96.

Cap 94 may be rigidly connected to the outside end 98*a* of horizontal water shaft 98. As shown in FIG. 5, cap 94 is rotatably connected to water shaft 98 by snap ring 94*c*. Two O-rings 94*a* and 94*b* maintain a sliding water seal between the inside of cap 94 and the outside of horizontal water shaft 98. Horizontal water shaft 98 has a hollow, internal water channel 100 which communicates with water channel 102 in cap 94 and with turbine jet 104, turbine jet 104 being rigidly connected to horizontal water shaft 98. The size of turbine jet 104 may be selected as desired to achieve the desired flow therethrough. If desired, a needle valve could be placed in channel 100 or 102 to selectively vary water flow therethrough.

As can best be seen in FIG. 5, horizontal water shaft 98 is rotatably received in circular openings 76*c* and 76*d* formed in inside wall 76*e* and outside wall 76*f* of turbine housing 76. Thus, water under superatmospheric pressure is conveyed from flexible tube 90 through rigid tube 96, channel 102, channel 100, and outward through turbine jet 104 as indicated by the arrow 84 in FIGS. 4 and 5 and the arrow 88 in FIG. 6.

Water exiting from nozzle 104 strikes turbine blades 76*b* and falls to the bottom of turbine housing 76 and exits through flexible drain tube 106 in the direction indicated by the arrow 108 in FIGS. 4–6. Flexible drain tube 106 is connected to rigid tube 107 which communicates with the interior of turbine housing 76 beneath horizontal water shaft 98. Flexible drain tube 106 is also connected to the lower end 46*b* of suction tube 46 in a low pressure region inside suction tube 46 in close proximity to inlet tube nozzle 57. The low pressure region caused by water exiting from inlet tube nozzle 57 is lower in pressure than the pressure on the water in the bottom of turbine housing 76 covering tube 107, and therefore water is forced by the pressure difference from the bottom of turbine housing 76 into drain tube 106 and into the lower end 46*b* of suction tube 46*b*.

An elongated, generally rectangular control arm 114 having two ends is rigidly connected at one end to the inside end 98*b* of horizontal water shaft 98. Control arm 114 has a rod holder assembly generally indicated by the numeral 116 which is rotatably connected to the other end of control arm 114. Control arm 116 is generally cylindrical in shape and has a reduced diameter portion 116*a* in the shape of a solid cylinder which is rotatably received in a hollow cylinder 114*a* formed in control arm 114. Rod holder assembly 116 has an increased diameter portion 116*b* in the shape of a solid cylinder to which control rod 118 is rigidly connected. Portions 116*a* and 116*b* of rod holder assembly 116 are rigidly connected together and are preferably integrally formed from a single material.

Turbine housing 74 has interior components (not shown) such as a turbine with turbine vanes identical to turbine 76*a* and vanes 76*b* respectively, and a rotatable nozzle assembly identical to rotatable nozzle assembly 92, which are identical to the interior components of turbine housing 76. As can best be seen in FIG. 3, turbine housing 74 has a cap 94*a* connected to the rotatable nozzle assembly (not shown) of turbine housing 74 which is identical to cap 94 connected to rotatable nozzle assembly 92 of turbine housing 76. Furthermore, cap 94*a* has a flexible tube 90*a*, which functions identically to flexible tube 90, connected thereto and to water inlet tube 56 through rigid tube 56*b* for supplying water under superatmospheric pressure to cap 94*a* and the turbine (not shown) inside turbine housing 74. A flexible drain tube 106*a* is connected to the bottom of turbine housing 76 and to the lower end 46*b* of suction tube 46 to drain water from turbine housing 74 in a manner identical to flexible drain tube 106 connected to turbine housing 76. The rotatable nozzle assembly (not shown) of turbine housing 74 has a control arm (not shown) and rod holder assembly (not shown) identical to control arm 114 and rod holder assembly 116 of turbine housing 76, together with the other components associated therewith. Thus turbine housings 74 and 76 and their associated components are identical and function in an identical manner as motors to drive wheels 16 and 18 respectively.

Control rod 118 controls the direction in which wheel 18 rotates and is connected to the diaphragm assembly generally indicated by the numeral 120 which is shown in detail in FIGS. 4 and 6. Diaphragm assembly 121 is identical to diaphragm assembly 120, has a control rod 118 extending therefrom identical to control rod 118 of diaphragm assembly 120 to control the direction in which turbine 74 causes wheel 16 to rotate, and a water inlet hose 137 connected thereto.

As can best be seen in FIGS. 4 and 5, diaphragm assemblies 120 and 121 have a flexible, circular shaped diaphragm 122 located in rigid diaphragm housing 124. Rigid diaphragm housing 124 is rigidly connected to the lower end 46*b* of suction tube 46 by bracket 47 and arm 47*a*. Diaphragm 122 is held firmly against the outer circular edge 124*a* of diaphragm housing 124 by circular diaphragm housing plate 126. Circular diaphragm housing plate 126 is pressed against diaphragm 122 by circular clamp 128 which extends around the periphery of diaphragm 122 and outer circular edge 124*a* of diaphragm housing 124.

Control rod 118 extends through the center of diaphragm 122 and through center of the recessed portion 124*b* of diaphragm housing 124. A spring 130 is fitted inside recessed portion 124*b* and contacts plate 132 which is rigidly connected to control rod 118. The center of diaphragm 122 is held between plates 132 and 134. Plate 134 is pressed tightly against diaphragm 122 and plate 132 and rigidly connected to control rod 118 by gluing, welding, or any other method known in the art.

Flexible tube or hose 136 is connected to rigid tube 126*a* extending from the outside of diaphragm housing plate 126 to supply water under superatmospheric pressure to the space in diaphragm housing 124 between plate 126 and diaphragm 120. When water under superatmospheric pressure flows from rigid tube 126*a* as indicated by the arrow 138 in FIG. 4, the pressure of the water entering through rigid tube 126*a* moves diaphragm 122 from the position shown in FIG. 6 to the position shown in FIG. 4, thereby moving control rod 118 from the position shown in FIG. 6 to the position shown in FIG. 4, and compressing spring 130. Water exits through rigid tube 126*b* to the pool as shown by the arrows 140 and 142 in FIG. 6. The relative inside diameters of rigid tubes 126*a* and 126*b*, the spring tension of spring 130, and the maximum pressure of water supplied by hose 136 are selected to insure full compression of spring 130 as shown in FIG. 4 when the pressure of water flowing through hose 136 is at a maximum.

Figure 8:
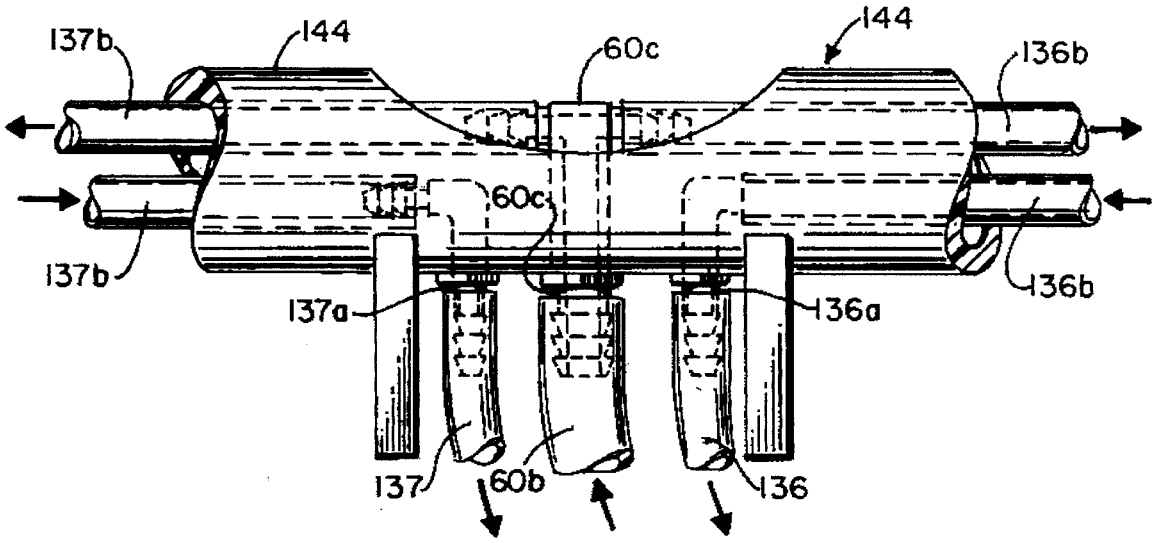
FIG. 8 is partly cross-sectional, partly cut-away view taken along lines 8—8 of FIG. 7.
Figure 7:
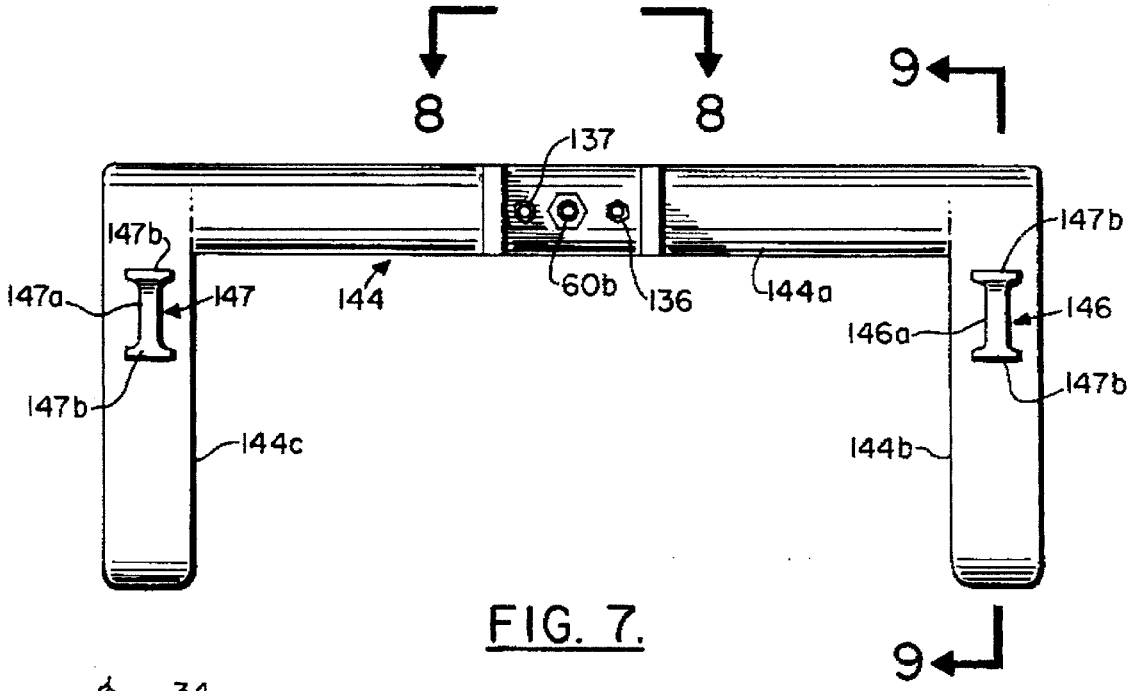
FIG. 7 is an elevational view of the control module of the invention.
Figure 9:
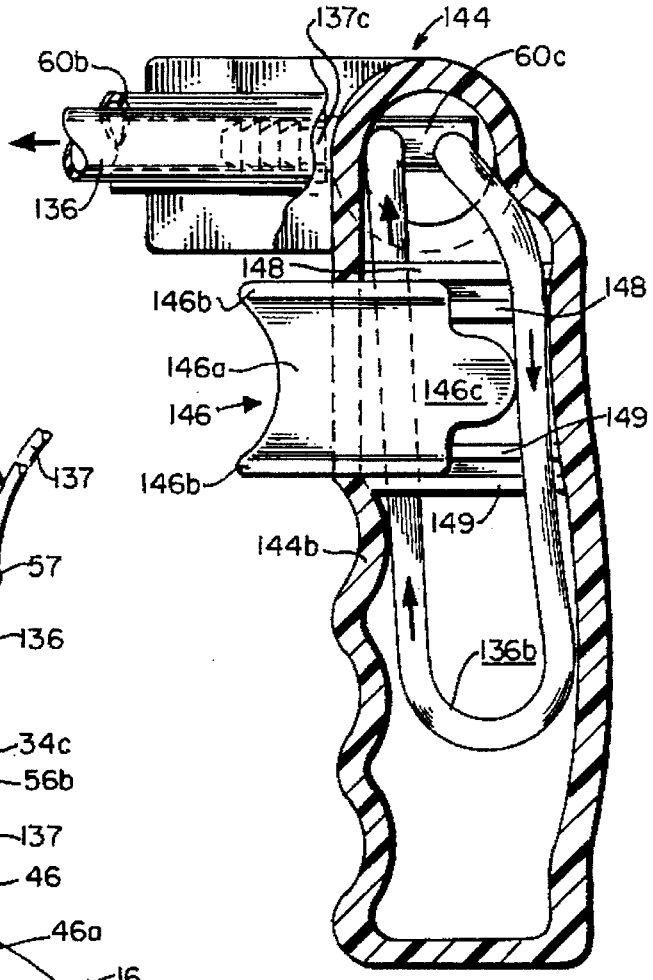
FIG. 9 is a partly cut-away, partly cross-sectional view taken along lines 9—9 of FIG. 7.

The flow of water to diaphragm assemblies 120 and 121 is controlled by the control manifold generally indicated by the numeral 144 in FIGS. 7–9. Control manifold 144 has hose 60*b* connected to rigid tube 60*c* thereon for supplying water under superatmospheric to control manifold 144. Hose 60*b* is connected to hose 60, and hose 60 is connected to water pump 58 for receiving and conveying water therefrom.

Control manifold 144 has two lines 136 and 137 connected thereto for supplying water under pressure to diaphragm assemblies 120 and 121, respectively. Lines 136 and 137 are connected to rigid tubes 136*a* and 137*a*, respectively, which are rigidly connected to manifold frame 144*a* and extend into the interior of manifold frame 144*a* as shown in FIGS. 8 and 9. Also connected to rigid tubes 136*a* and 137*a* are flexible tubes 136*b* and 137*b*, respectively. Flexible tubes 136*b* and 137*b* are also connected to rigid tube 60*c*, and receive water under superatmospheric pressure therefrom. Flexible tubes 136*b* and 137*b* are located inside of control manifold frame 144*a*.

Figure 11:
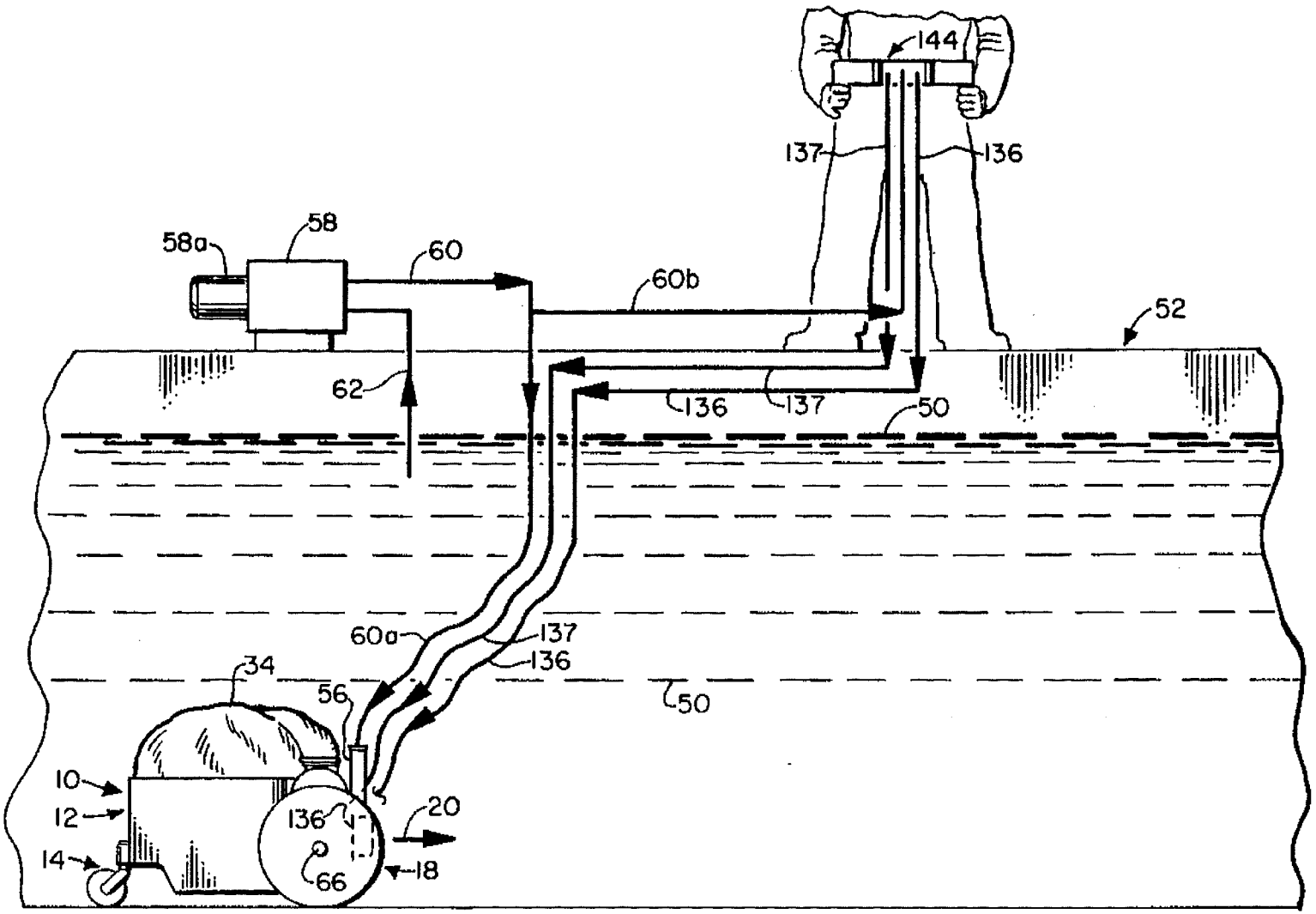
FIG. 11 is a partly cut-away, schematic view of the present invention on the bottom of a pool being controlled by the control module operator.

Control manifold frame 144*a* includes two handles 144*b* and 144*c* adapted for grasping by the hands of the user as shown in FIGS. 7, 9, and 11. Handles 144*b* and 144*c* each has a trigger 146 and 147, respectively, for selective actuation by a finger of the user to control the direction and speed which wheels 18 and 16, respectively, are turning.

Each of the triggers 146 and 147 are generally shaped similar to an I-beam and have webs 146*a* and 147*a*, respectively. Each of the webs 146*a* and 147*a*, connect a pair of flanges 146*b* and 147*b*, respectively. In FIG. 9, flanges 146*b* are shown to travel in tracks 148 and 149, which are rigidly connected to the inside of control manifold frame 144*a*. Trigger 146 has a protuberance 146*c* thereon which contacts flexible tube 136*b* and presses thereagainst when the finger of the user forces trigger 146 inward against flexible tube 136*b*, thereby constricting flexible tube 136*b* and reducing, or stopping, the flow of water therethrough.

Thus flow through tube 136*b* and tube 136 can be decreased from full flow and full pressure by forcing the user's index finger against trigger 146, thereby changing the direction in which wheel 16 is turning by rotating jet 104 shown in FIG. 4 and 6 to a desired position. When jet 104 is vertical, there will be no rotation of the turbine and the wheel will remain stationary. Thus, through proper manipulation of triggers 146 and 147, the cleaning apparatus of the invention will spin on one wheel, travel in a straight line forward or in reverse, rotate about a central vertical axis between wheels 16 and 18, or travel along a curved path.

Preferably, the components of the invention are constructed from a polymeric material, preferably reinforced with glass fibers or the like for greater strength. Exemplary of such materials are thermoplastic and thermosetting homopolymers and co-polymers of organic compounds well known in the art for use in making polymeric structures such as vinyl chloride, vinyl acrylate, and the like. Such polymeric materials are preferred because of there resistance to corrosion and their strength. However, metal components may be used as desired. Particularly preferred metals are stainless steel and aluminum.

The present invention employs the full force of water pumped from pump 58 to drive wheels 16 and 18 in any direction. Traction is good and no rudder is needed to guide the apparatus. The maximum speed of travel for a given pump pressure can be changed by changing the size of jet 104.

Although the preferred embodiments of the invention have been described in detail above, it should be understood that the invention is in no sense limited thereby, and its scope is to be determined by that of the following claims:

What is claimed is:

1. A water powered apparatus for cleaning aquatic bodies comprising:

a. a rigid frame, b. bin means connected to said rigid frame for collecting and holding debris removed from said aquatic body, said bin means being removable from said rigid frame, said bin means having rigid, vertical walls, said bin means having a membrane connected to the bottom of said rigid, vertical walls, c. wheel means connected to said rigid frame for supporting and moving said apparatus along the bottom of said aquatic body, at least two of said wheel means being drive wheel means, d. motor means for driving said drive wheel means, said motor means being driven by water under pressure, and e. suction tube means connected to said rigid frame for inducting water from said aquatic body into said bin means.

2. The apparatus of claim 1 wherein said bin means has a membrane removably connected to the top of said rigid, vertical walls.

3. The apparatus of claim 1 wherein said bin means is removably connected to said rigid frame.

4. A water powered apparatus for cleaning aquatic bodies comprising:

a. a rigid frame, b. bin means connected to said rigid frame for collecting and holding debris removed from said aquatic body, c. wheel means connected to said rigid frame for supporting and moving said apparatus along the bottom of said aquatic body, at least two of said wheel means being drive wheel means, d. motor means for driving said drive wheel means, said motor means being driven by water under pressure, said motor means comprising two turbine means for rotating said wheel means, said turbine means being connected to said rigid frame, said turbine means having a rotatable turbine wheel for forcing said wheel means to rotate, said turbine wheel having turbine blades thereon, said turbine wheel being forced to rotate by water under pressure impinging thereon, said turbine means including two of said turbine wheels, each of said turbine wheels driving one of two drive wheels, each of said two turbine wheels having a water hose adjacent thereto connected to said turbine means for supplying water under pressure to each of said turbine wheels, each of said two turbine means has rotatable jet means connected thereto for spraying water onto said turbine wheels to cause said turbine wheels to turn and to control the direction in which said turbine wheels turn, and e. suction tube means connected to said rigid frame for inducting water from said aquatic body into said bin means.

5. The apparatus of claim 4 wherein each of said rotatable jet means has control means connected thereto for selectively rotating said jet means to cause said turbine wheels to rotated in the desired direction.

6. The apparatus of claim 5 wherein each of said control means includes a diaphragm assembly having a diaphragm therein and a water supply means connected thereto for selectively moving said diaphragm in response to the flow of water impinging upon said diaphragm to cause said jet means to rotate.

7. The apparatus of claim 6 wherein said diaphragm assembly has means for allowing water to exit from said diaphragm assembly after impinging on said diaphragm.

8. A water powered apparatus for cleaning an aquatic body comprising:

a. a rigid frame having an upper part and a lower part, b. bin means connected to said rigid frame for collecting and holding debris removed from said aquatic body, said bin means being removably connected to said rigid frame, said bin means having an upper portion and a lower portion, said bin means having lugs on the lower portion thereof which fit into openings in said lower part of said rigid frame, said bin means having bracket means thereon which fit into openings in said upper part of said rigid frame and are connected to said rigid frame, c. wheel means connected to said rigid frame for supporting and moving said apparatus along the bottom of said aquatic body, d. motor means for driving said drive wheel means, said motor means being driven by water under pressure, and e. suction tube means connected to said rigid frame for inducting water from said aquatic body into said bin means.

9. The apparatus of claim 8 wherein said suction tube means is hollow and has a source of water under superatmospheric pressure connected thereto for forcing water therethrough.

10. The apparatus of claim 8 wherein said bin means has a wheel connected thereto for contacting the bottom of said aquatic body and supporting said bin means.

11. The apparatus of claim 8 wherein said motor means comprise has turbine means for rotating said wheel means.

12. The apparatus of claim 11 wherein said turbine means are connected to said rigid frame.

13. The apparatus of claim 12 wherein said turbine means has a rotatable turbine wheel for forcing said wheel means to rotate.

14. The apparatus of claim 13 wherein said turbine wheel has turbine blades thereon.

15. The apparatus of claim 14 wherein said turbine wheel is forced to rotate by water under pressure impinging thereon.

16. The apparatus of claim wherein said turbine means includes two of said turbine wheels, each of said turbine wheels driving one of two drive wheels.

17. The apparatus of claim 16 wherein each of said two turbine means has a water hose connected thereto for supplying water under pressure thereto.

18. The apparatus of claim 17 wherein each of said two turbine means has rotatable jet means connected thereto for spraying water onto said turbine wheels to cause said turbine wheels to turn and to control the direction in which said turbine wheels turn.

19. A water powered apparatus for cleaning aquatic bodies which may be driven by an operator standing on the surface surrounding the aquatic body in a desired path around the bottom of the aquatic body, comprising:

a. a rigid frame, b. bin means connected to said rigid frame for collecting and holding debris removed from said aquatic body, c. at least two wheel means connected to said rigid frame for supporting and moving said apparatus along the bottom of said aquatic body, each of said wheel means having motor means for driving each of said wheel means, said motor means being driven by water under pressure, d. control means for operation by said operator, said control means being connected to said frame means and extending to the surface surrounding said aquatic body for controlling the direction in which each of said wheel means turns to control the direction in which said apparatus is traveling, and e. suction tube means connected to said rigid frame for inducting water from said aquatic body into said bin means.

20. The apparatus of claim 19 wherein said bin means has a caster wheel connected thereto for supporting said bin.

21. The apparatus of claim 19 wherein said each of motor means is a turbine and may drive said wheel means in any desired rotational direction by reversing the rotation of said turbine.

22. The apparatus of claim 19 wherein said control means has dual controls for controlling the direction of rotation of each of said motor means to force said wheel means to rotate at different rotational speeds.

23. The apparatus of claim 19 wherein said bin means is removably connected to said frame means.

24. The apparatus of claim 19 wherein said control means is connected to said frame means by flexible hoses.

25. The apparatus of claim 24 wherein said hoses are water hoses for selectively conveying water under pressure to said motor means.

26. The apparatus of claim 19 wherein said frame means has rigid vertical walls enclosing a first membrane connected to the bottom of said vertical walls for enabling water to drain from said frame means.

27. The apparatus of claim 26 wherein said bin means has second membrane means connected to the top of said rigid walls through which water from said suction tube flows for collecting debris from said water flowing therethrough.

28. The apparatus of claim 26 wherein said second membrane is removably connected to said bin.

29. The apparatus of claim 28 wherein said second membrane is removably connected to said bin.

* * * * *